US009662691B2

(12) United States Patent
Lund

(10) Patent No.: US 9,662,691 B2
(45) Date of Patent: May 30, 2017

(54) PIPELINE PIG APPARATUS, AND A METHOD OF OPERATING A PIG

(75) Inventor: Fredrik Lund, Trondheim (NO)

(73) Assignee: EMPIG AS, Trondheim (NO)

( * ) Notice: Subject to any disclaimer, the term of this patent is extended or adjusted under 35 U.S.C. 154(b) by 892 days.

(21) Appl. No.: 13/977,975

(22) PCT Filed: Dec. 30, 2011

(86) PCT No.: PCT/EP2011/074313

§ 371 (c)(1),
(2), (4) Date: Sep. 11, 2013

(87) PCT Pub. No.: WO2012/093079

PCT Pub. Date: Jul. 12, 2012

(65) Prior Publication Data

US 2013/0340793 A1 Dec. 26, 2013

(30) Foreign Application Priority Data

Jan. 3, 2011 (NO) ..... 20110003

(51) Int. Cl.
*B08B 9/055* (2006.01)
*B08B 9/043* (2006.01)
*B08B 9/049* (2006.01)

(52) U.S. Cl.
CPC ..... *B08B 9/0553* (2013.01); *B08B 9/049* (2013.01); *B08B 9/0436* (2013.01)

(58) Field of Classification Search
CPC ..... B08B 9/04; B08B 9/0436; B08B 9/049; B08B 9/0553; F16L 55/26; F16L 55/28;
(Continued)

(56) References Cited

U.S. PATENT DOCUMENTS 2,812,921 A * 11/1957 Leith, Jr. ..... B08B 9/04 15/104.16
3,900,912 A * 8/1975 Lenz ..... B08B 9/0553 15/104.061

(Continued)

FOREIGN PATENT DOCUMENTS

FR 2 630 934 A1 11/1989
GB 2 141 201 A 12/1984

(Continued)

OTHER PUBLICATIONS

International Search Report issued in PCT/EP2011/074313 mailed on Dec. 17, 2012 (3 pages).

(Continued)

*Primary Examiner* — Michael Kornakov
*Assistant Examiner* — Natasha Campbell
(74) *Attorney, Agent, or Firm* — Osha Liang LLP

(57) ABSTRACT

A bi-directional pig apparatus for removing wax and hydrate deposits in subsea hydrocarbon production flowlines including a pig arranged for movement inside a pipe, the pig having a tubular body and one or more magnets arranged in a circumferential wall of said body, each of the one or more magnets includes an elongated bar having a succession of teeth and slots, arranged such that the succession of teeth are facing radially outwards. The apparatus having a through-going opening between opposite ends of said tubular body to allow fluids (F) in the pipe to flow through and propulsion means arranged and configured for imparting a motive force to the pig, whereby the pig is movable inside the pipe.

8 Claims, 8 Drawing Sheets

(58) Field of Classification Search
CPC ..... F16L 55/30; F16L 55/40; F16L 2101/10; F16L 2101/12
See application file for complete search history.

(56) References Cited

U.S. PATENT DOCUMENTS

| | | | | |
|---|---|---|---|---|
| 7,500,834 | B2 * | 3/2009 | Durward ..... | F16L 55/26 137/15.04 |
| 2001/0047811 | A1 | 12/2001 | Sivacoe | |
| 2003/0217422 | A1 | 11/2003 | Tsai | |
| 2003/0217763 | A1 | 11/2003 | Chang et al. | |

FOREIGN PATENT DOCUMENTS

| | | | |
|---|---|---|---|
| GB | 2 227 805 | A | 8/1990 |
| GB | 2274898 | A | 8/1994 |
| WO | 02/42601 | A1 | 5/2002 |
| WO | 2006/068929 | A1 | 6/2006 |

OTHER PUBLICATIONS

Written Opinion of the International Searching Authority issued in PCT/EP2011/074313 mailed on Dec. 17, 2012 (6 pages).
International Preliminary Report on Patentability from PCT/EP2011/074313 issued on May 6, 2013 (15 pages).
Norwegian Search Report issued in Patent application No. 20110003 dated Jul. 27, 2011 (1 page).

* cited by examiner

PIPELINE PIG APPARATUS, AND A METHOD OF OPERATING A PIG

FIELD OF THE INVENTION

The invention relates to an apparatus and a method of controlling the movement of an object within a tubular object, such as a cylinder, a tube or a pipeline; a fluid flow processing plant, and a method of cleaning the internal wall of a tubular object, as set out in the introduction to the independent claims.

BACKGROUND OF THE INVENTION

Pipes and pipelines in general normally require cleaning, testing or gauging, and for this purpose it is well known to use a so-called "pig." The pig is designed to fit closely within the pipe and is caused to travel along the pipe by admitting fluid under pressure behind the pig. Pigs are also used in operation of a pipeline to separate different fluids (liquids and gases) delivered in succession. The pigs are of various designs, the more common type being of spool shape with annular sealing members around the two flanges of the spool. Other pigs are of generally cylindrical shape, formed of resilient material such as foamed plastics, and it is also common practice to use spherical pigs, either of a solid resilient material, or inflated or inflatable.

Pipelines that are used to transport products such as petroleum, gas or other fluids can become blocked or inefficient through the build up of deposits on the pipe walls. The deposits can be foreign material, detritus, or natural waste products such as, for example, paraffin, calcium, wax and hydrates. It is well know to insert a pig into the pipe in order to clean it. The pig is transported by the fluid pressure along the pipe and has an outer periphery that is of a size that is similar to the diameter of the inside surface of the pipe. Thus, as the pig travels along the pipe—along with fluid flow in the pipe—it serves to remove deposits from the inner surface by scraping or brushing, or simply by pushing the deposits ahead of it as it travels to a point where it can be removed along with the released deposits. Such mono-directional pigs, which are transported along with the fluid flow, may become stuck when it encounters large amounts of pipe wall deposits, and thus form a permanent plug in the pipeline.

In the oil and gas industry, the necessity of pigging operations is especially significant. Severe problems often occur when hydrocarbon fluids are transported in long subsea pipelines at large depths and in cold waters. Such problems may include the formation of obstructions in the pipeline, in the form of hydrates or other deposits such as ice, wax and debris (e.g. asphaltenes, sand). The initially warm well fluid is cooled down by cold seawater, thereby inducing condensation, precipitation and hydrate and wax formation/crystallization. A number of methods of removing such wax and hydrate formation, or preventing the formation of such, exist:

- Adding chemicals (such as methanol or mono-ethylene glycol; MEG) to the well fluids. This is a costly method (installation, self-cost and regeneration plants) and is detrimental to the environment.
- Using direct electric heating (DEH), i.e. arranging electrical cables along the pipeline in order to maintain the well fluids at a temperature above the temperature at which wax precipitates ("wax appearance temperature"—WAT). This method entails costly equipment, installation work and operation. Power availability and infrastructure to transfer it, is a major cost driver when producing far from land or topside installation
- Thermal insulation in the form of applying thermal cladding (insulation) around the pipeline and/or burying it in the seabed. Alternatively a pipe-in-pipe configuration. Both require additional materials and increase the cost of pipe fabrication and installation.
- Rock dumping and dredging pipelines is done mainly to insulate the pipes further, keeping the flow warm. This is a time consuming activity that also represent extra costs.
- Using a pig, as described above. There are several disadvantages associated with the known pigs. A pigging system typically comprises a pig launching station and a retrieving station which each comprise an assembly of isolation valves, a trap barrel, an entry hatch and a bypass valve that enable an operator to launch a pig into the pipeline safely and to retrieve it at the other end. The trap barrels are generally closed at one end and situated outside the main pipeline. The system tends take up a large volume and is heavy. Also, the well stream production must in many cases be reduced in order not to impose too high a pressure on the pig.
- All the measures taken to prevent formation or hydrate and wax deposits today have limits when it comes to transportation distance. The longer the pipe, the higher the cost. For long step-out fields like the Stockman, present methods are not technically or economically applicable.

A simple and reliable system for ensuring subsea transport of hydrocarbons over long distances is to allow so-called "cold flow". If the well stream fluids, pipeline wall and the ambient seawater all are at the same temperature, wax deposits do not form on the interior pipe wall surface, but are transported together with the well fluid without problems. Cold flow is normally achieved by allowing the well stream to be cooled to ambient seawater temperature simply by heat exchange through the pipeline wall. However, severe hydrate and wax formation will take place in the pipeline section where cooling takes place. This relatively short cooling section will therefore have to be pigged more frequently.

The state of the art includes WO 2006/068929 A1 which describes a system for assuring subsea hydrocarbon production flow in pipelines. A hydrocarbon production flow is chilled in a heat exchanger, whereby solids form, and a pig is used for periodically removing deposits and placing them in a slurry. A closed loop pig launching and receiving system is disclosed. A production flow from wells is transported from a manifold to a cold flow module through flow line. The cold flow module is connected to a chilling loop/heat exchanger, which returns to cold flow module. Pig launcher and handling systems are connected to the heat exchanger. The pig is driven by the fluid flow and may alternatively be launched through the heat exchanger and recovered at a terminus, whether that is on an offshore platform or onshore.

The state of the art also includes WO 02/42601, describing an alternative pig propulsion method.

The present applicant has devised and embodied this invention to overcome shortcomings of the prior art and to obtain further advantages.

SUMMARY OF THE INVENTION

The invention is set forth and characterized in the main claims, while the dependent claims describe other characteristics of the invention.

It is thus provided a pig apparatus, comprising a pig arranged for movement inside at least a portion of a pipe, characterized in that the pig comprises a tubular body having a longitudinal axis coinciding with the central axis of the pipe portion and at least one through-going opening between the opposite ends of the tubular body, allowing fluids in the pipe to flow through the body, the apparatus further comprising propulsion means arranged and configured for imparting a motive force to the pig, whereby the pig is movable inside the pipe portion independently of the fluid flow of in the pipe.

In one embodiment, the pig comprises a magnetic material, the pipe portion comprises a material of high magnetic permeability, and the propulsion means are arranged outside the pipe portion or in the wall of the pipe portion and comprises means for controllably generating a magnetic field which influences the pig.

In one embodiment, the pig comprises a non-magnetic body having one or more magnets comprising a permanent magnet or a magnetizable material arranged in a circumferential wall of said body. The pig comprises in this embodiment one or more wall cleaning means arranged around the outside circumference of the body, and the magnet comprises a rod having a succession of teeth and slots, arranged such that the teeth are facing radially outwards.

In one embodiment, the propulsion means comprises electromagnetic coils, arranged along the outside of said pipe portion, and a power-and-control apparatus arranged for selectively energising the coils and thereby varying the magnetic field along at least a part of the pipe portion.

In one embodiment, the propulsion means comprises a vehicle having at least one magnet and being arranged and configured for movement along at least a part of the pipe portion, whereby when the vehicle is moved along the pipe portion, the pig is moved along with the vehicle due to the magnetic force generated between the magnet and the magnetic material in the body. The vehicle advantageously comprises wheels and a motor for moving the vehicle along the pipe portion, and the at least one magnet is a permanent magnet or an electromagnet. In one embodiment, the vehicle comprises one or more cleaning elements arranged and configured for cleaning a portion of the pipe outer surface as the vehicle is moving along the pipe.

In one embodiment, the pig further comprises a flow assurance device having wall-cleaning means arranged around at least a portion of the pig body.

It is also provided a fluid flow processing plant, comprising a feed pipeline fluidly connected to a fluid reservoir and arranged for feeding fluid into the plant, and an export pipeline for conveying the fluid away from the plant, characterized by at least one intermediate pipe fluidly connecting the feed pipeline with the export pipeline and comprising a pipeline pig apparatus according to the invention.

In one embodiment, the plant further comprises a plurality of intermediate pipes arranged substantially parallel with each other and connected to the feed pipeline and the export pipeline via an inlet manifold and an outlet manifold, respectively, each one of the plurality of intermediate pipes comprising a pig and propulsion means. The plant advantageously comprises vehicle units comprising adjacent vehicles for individual pipes, coupled together, as well as charging means for the vehicle or vehicle units.

In one embodiment, the plant is supported on the seabed below a body of water and the reservoir is one or more subterranean reservoir producing a flow of hydrocarbons having a temperature which is higher than the ambient seawater temperature, and where a plurality of intermediate pipes is configured and arranged on the seabed so as to cool the flow of hydrocarbons to a temperature at the same level as that of the ambient seawater, thus defining a cooling section for the flow.

In one embodiment, the plant comprises a return line fluidly connected between the export pipeline and the feed pipeline adjacent to the inlet of the intermediate pipe of pipes, and pumping means and valve means arranged in the return line, whereby a portion of the flow in the export pipeline may be fed into the flow upstream of the cooling section.

It is also provided a method of cleaning the internal wall of a pipeline by means of a device according to the invention inside the pipe, arranged for coaxial movement with the pipe and having cleaning means for interaction with at least a portion of the pipe wall, characterized by imparting a motive force on the device from a distal location. In one embodiment, the motive force is a magnetic force generated by a controlled manipulation of an electromagnetic field in the vicinity of the device, e.g. outside the pipe or in the pipe wall. In another embodiment, the motive force is a magnetic force generated in a vehicle which is moved along the pipe.

It is also provided a method of moving a device in a pipe, said device comprising a tubular body having a longitudinal axis coinciding with the central axis of the pipe and configured for coaxial movement with the pipe, characterized by imparting a motive force on the device from a distal location. In one embodiment, when the device comprises a magnetic material and the pipe comprises a material of high magnetic permeability, the motive force is a magnetic force generated by a controlled manipulation of an electromagnetic field in the vicinity of the device. In one embodiment, the motive force is a magnetic force generated in a vehicle which is moved along the pipe.

With the invention, wax and hydrate deposits, etc., in subsea hydrocarbon production flowlines may be removed in an efficient manner. The invented plant uses the rapid cooling of the flow in the cooling section, removing deposits, etc. to assure long distance export of hydrocarbons below Wax Appearance Temperature (WAT).

The invention is applicable to any hydrocarbon flow, such as multiphase, oil, gas and condensate where deposits, wax and hydrate might be a problem, and to other types of flow or production in pipes where deposits, debris or material sticking on the interior pipe walls may occur. Examples of such other fluid flows are water, coolants, fuels, or sewage.

In the cooling section, cooling may be improved by actively forcing water (or air, if on land) over the cooling pipes, by e.g. propellers, fans, etc. Circulation around the cooling pipes is enhanced by natural convection, and the cooling pipes may be arranged in an inclined configuration in order to further utilize this effect. Natural ocean currents may also be useful in the cooling process, e.g. by arranging the pipes transversely with respect to the currents. The pipes in the cooling section may also comprise a pipe-in-pipe arrangement, where the well fluids flow in an inner pipe, and cooling fluids flow in the annulus between the inner pipe and the outer pipe, preferably in the opposite direction of the well fluids. The length of the cooling section will depend on production volume and flow rates, as well as the contents and temperature of the fluid. The greater the number of parallel intermediate pipes, the shorter the length of the cooling section. The flow in the pipes is mixed (turbulent) and homogenous such that the hydrocarbons do not separate in the plant and in order to improve cooling.

The magnetic trolley is retrievable and can easily be replaced if malfunction occurs. One trolley can control one or more pigs. The trolley or trolley unit may contain electronics, batteries (optional battery driven), electro motors, permanent magnets or electro magnets for interlocking trolley and pig. The electro magnets in the trolley can be used to inductively warm the pig body inside the pipe. This can be advantageous to clean the pig or to melt hydrate or wax plugs form the pipe inside walls. Power is provided via umbilical/tether from an adjacent unit, via cables on the sea floor or on reels, or via electricity passed through the pipes or rails on the pipes. The trolley or trolley unit may be rechargeable via docking and recharging stations at one or both ends of the cooling section.

The invented pig is basically a passive device, containing few moving parts and being of a simple design. The pig does not have any on-board propulsion mechanism, but is driven by external means, such as magnetic fields. The pig is propelled in the pipe by magnetic inter-locking with a moving trolley outside the pipe, or by a magnetic field (generated by electromagnetic spools) which varies along the length of the pipe.

It is possible to communicate with the pig through the pipe wall, and the pig may advantageously be furnished with sensors, RFID tags and the like.

The invented pig is a bi-directional pig. It can be moved in both directions in the pipe, relatively independent of flow direction, i.e. also against the flow direction. The invented hollow pig is fail-safe, in that its through-going bore allows flow of well fluids in the pipeline even in the event that the pig is impeded and unable to move in the pipeline.

Spinning, vibrating, shaking or hammering motion is possible with right magnetic field created in trolley. The angle, direction, strength and frequency of the magnetic field will affect the pig in different ways. It is also possible to adapt and configure the pig set-up and construction to different movement patterns.

The invention provides an efficient tool for removing ice from a pipe, both on the inside wall (by the pig) and on the outside wall (by the cleaning elements on the trolley).

While a pig according to the prior art will not move if the pipe is completely clogged, the invented hollow pig, being independent of the fluid flow, may be moved to the plug (e.g. deposits) which is clogging the pipe, and start working (hammering, heating, melting) on the plug in order to remove it and restore fluid flow in the pipeline.

BRIEF DESCRIPTION OF THE DRAWINGS

These and other characteristics of the invention will be clear from the following description of preferential forms of embodiment, given as non-restrictive examples, with reference to the attached schematic drawings wherein.

DETAILED DESCRIPTION OF A PREFERENTIAL EMBODIMENT

Figure 1:
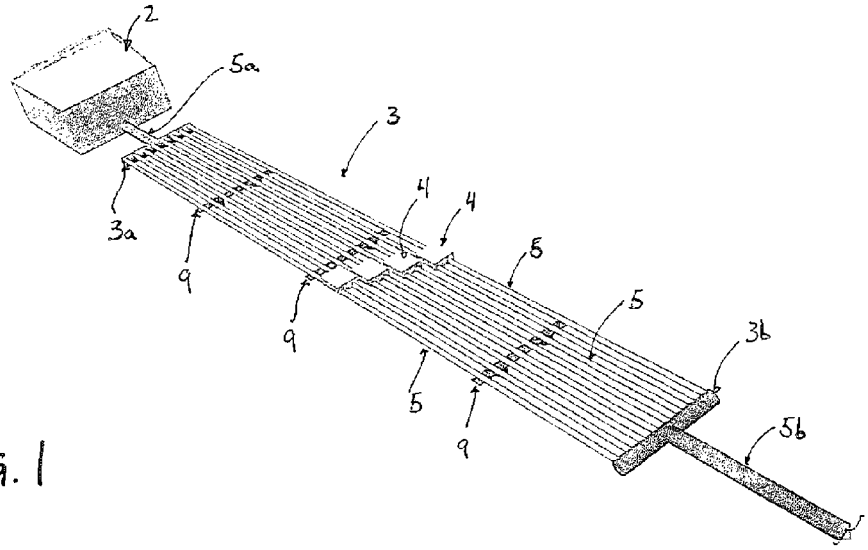
FIG. 1 is a perspective view of a subsea processing plant according to the invention.

FIG. 1 is a schematic illustration of a subsea processing plant placed on a seabed (not shown). FIG. 1 is not intended to show all of the elements normally included in a subsea production system, such as flow line jumpers, pipeline skids and other necessary equipment, but is simply intended to provide a context for the present invention. For example, the plant may comprise conventional pig launchers in order for the operator to use conventional back-up pigging in certain situations, such as at start-up, etc.

The subsea plant may in general comprise or be connected to satellite wells, well manifolds and templates, etc., as the skilled person will appreciate. FIG. 1 shows an example where a so-called Pipeline End Manifold (PLEM) 2 receives well fluids from e.g. a plurality of wellheads, satellites, etc., (not shown). The PLEM 2 is connected to an onshore plant or topsides platform (not shown) via an export pipeline 5*b*. The well fluids, having been extracted from subterranean wells, are warm, compared to the surrounding seawater, when they emanate from the PLEM in the pipe section 5*a*. In practical applications, the flowlines feeding warm well fluids to the PLEM are insulated (e.g. buried underground) in order to prevent wax and hydrate formation in these flowlines. Additionally or alternatively, these flowlines may also comprise separate pigging systems, as are known in the art.

A plurality of pipes 5 are arranged substantially parallel and with a distance between each other, and each pipe 5 is in one respective end connected to the PLEM via an inflow manifold 3*a* and the pipe section 5*a*, and in the other end connected to the export pipeline 5*b* via an outflow manifold 3*b*. The pipes 5 and the inflow and outflow manifold define a cooling section 3 for the subsea plant, and the length of each pipe in the cooling section is designed such that the well fluids will have reached a temperature which is at or near the temperature of the ambient seawater or the pipe wall by the time they reach the outflow manifold 3*b*. The inflow manifold serves to split the flow from the pipe section 5*a* into the pipes 5, and the outflow manifold serves as a confluence for the cooled flow, into the export pipeline 5*b*. The pipes have small diameters (e.g. between 3" to 8") compared to the export pipeline, in order to increase surface area for effective cooling.

It should be understood that the pipes of the cooling section may be arranged in a number of ways, in order to best utilize the properties of the cooling medium (e.g. seawater) and the seabed topography. It should also be understood that the pipes of the cooling section need not necessarily be placed on a seabed, but may be arranged at any depth in the water, suspended by e.g. buoys in a manner which is generally known in the art.

By arranging the pipes in such side-by-side relationship, efficient cooling is obtained over a comparably short distance. Pipe supports 9 elevate the cooling section above the ground (seabed, not shown) in order to expose the pipes' entire circumference to seawater and thus achieve efficient cooling.

FIG. 1 also illustrates a plurality of trolley units 4, each trolley unit straddling two pipes 5. The details and function of these units will be discussed later in this specification.

Figure 2:
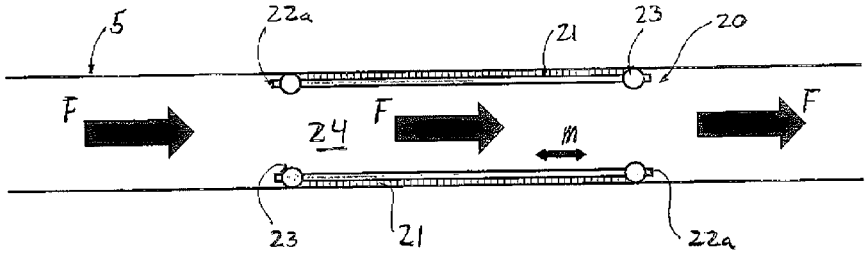
FIG. 2 is a longitudinal section view of a pipe and a bidirectional pig according to the invention.

Turning now to FIG. 2, which is a schematic longitudinal section of a portion of a pipe in the cooling section, a so-called "pig" 20 is arranged within the pipe 5. The pig 20 comprises in the illustrated embodiment a tubular body 22*a* having wheels 23 for supporting the pig against the internal wall of the pipe 5. Bristles 21 are arranged on the pig body and bearing against the internal wall. The bristles may be replaced by other means (wipers, scrapes, brushes, etc.) for cleaning the pipe wall. By virtue of the open pig body, effectively defining a channel 24 between the two ends of the pig, well fluids may flow through the pig, (flow indicated by arrow F) and the pig may be moved in either direction inside the pipe, as illustrated by the double arrow M.

Figure 3A:
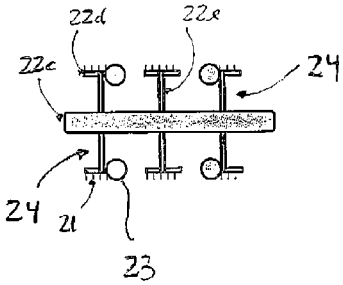
FIGS. 3*a* and 3*b* are longitudinal and cross section views, respectively, of another embodiment of the bidirectional pig.
Figure 3B:
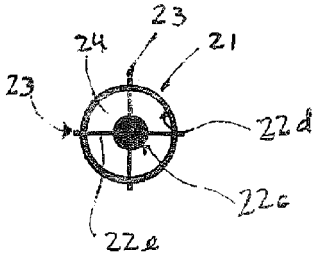
Figure 4A:
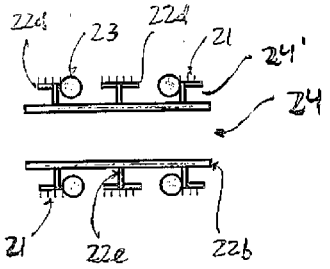
FIGS. 4*a* and 4*b* are longitudinal and cross section views, respectively, of yet another embodiment of the bidirectional pig.
Figure 4B:
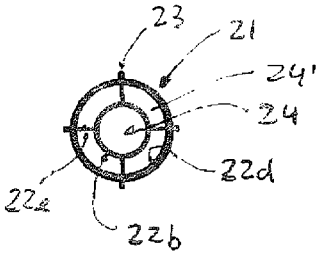

FIGS. 3*a*, 3*b* and 4*a*, 4*b* illustrate further embodiments of the pig. In FIGS. 3*a* and 3*b* the pig comprises a central solid core body 22*c*. The wheels and bristles are arranged on ring segments 22*d* which are supported by the central core via the radially extending struts 22*e*. In this embodiment of the pig, the flow of well fluids pass through the channel 24, having the form of an annulus defined by the core 22*c* and the ring segments. In FIGS. 4*a* and 4*b* the tubular body 22*b* is smaller than that illustrated in FIG. 2. The bristles 21 and wheels 23 are arranged on ring segments 22*d* which are supported by the tubular body via radially extending struts 22*e*. Thus, well fluids may flow through channel 24 in the tubular body 22*b* and through the annulus 24' formed by the tubular body and the ring segments. In all of these embodiments of the pig, well fluid may flow virtually unimpeded through the pig, and the pig may be moved in either direction inside the pipe 5, regardless of well fluid flow. That is, the invented pig is movable in the pipe even when there is no fluid flow.

The pig may be moved in the pipe 5 by mechanical means, such as a winch and wire arrangement (not shown) inside the pipe, or by another known method. It is preferred, however, to effect pig movement by controlling magnetic fields, as described in the following.

The pipe 5 is in this embodiment of a material that allows for magnetic fields to pass through the pipe wall, i.e. a material with high magnetic permeability. Preferred pipe materials comprise a non-magnetic material such as titanium, ceramics, plastics, composite (GFRP, CRFP), aluminium, or stainless steel (austenitic). In order to provide efficient cooling of the well stream, the pipe material is advantageously of high thermal conductivity. Metallic cooling pipes must be compatible with or isolated from the rest of the pipe line system for Cathodic Protection (CP) purposes.

The pig body comprises a ferromagnetic material that is responsive to an external magnetic field, or/and a permanent magnetic (PM) material. The magnetic material in the pig is preferably either a magnetizable material or a permanent magnet material.

Figure 16A:
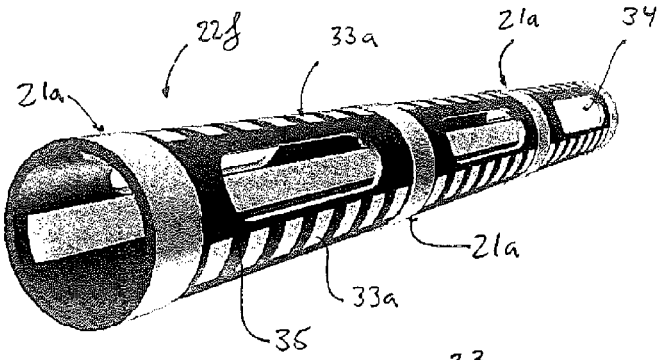
FIG. 16*a* is a perspective view of yet another embodiment of the invented bidirectional pig.
Figure 16B:
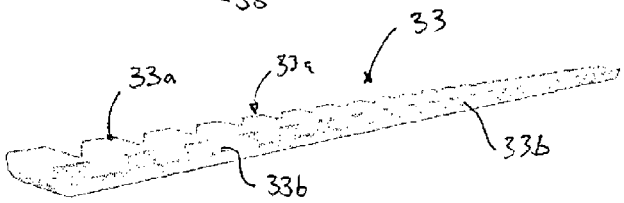
FIG. 16*b* is a perspective view of a magnetic element used in the pig illustrated in FIG. 16*a;*
Figure 16C:
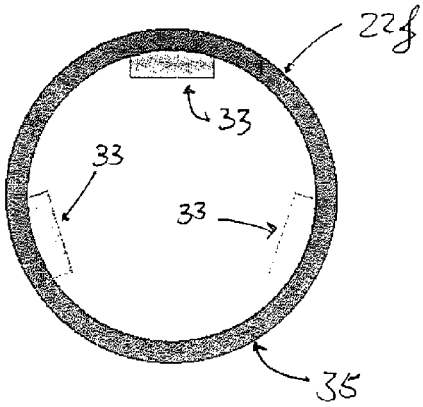
FIG. 16*c* is an end view of the pig illustrated in FIG. 16*a;*
Figure 20:
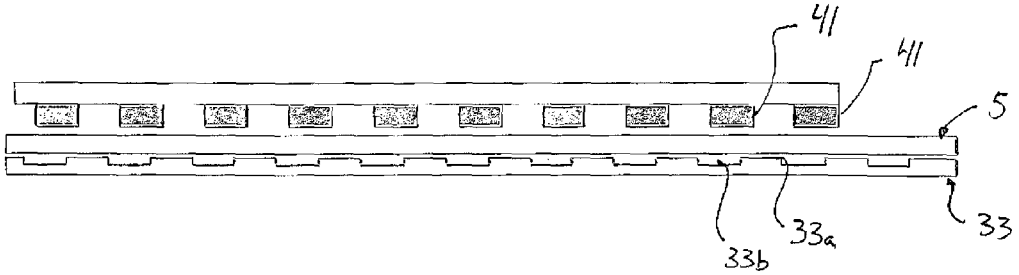
FIG. 20 is a schematic illustration of how a pig magnet inside a pipe is arranged in relation to a motive magnet outside the pipe.

Referring to FIGS. 16*a-c*, the pig 22*f* is in the illustrated embodiment made up of a non-magnetic body 35 having a plurality of magnets 33 and venting openings 34. Circumferential scraper rings 21*a* are arranged at regular intervals along the pig body, serving also as support surfaces for the pig against the pipe wall, thus obviating the need for the wheels described above. The magnets 33 (e.g. ferromagnetic/magnetizable material or PM) are shaped as elongate bars having a plurality of teeth 33*a* separated by slots 33*b*. This toothed structure provides a favourable flux density distribution that enhances the magnetic force between the trolley and the pig. This will in particular be beneficial for maximized axial connection/pull force from trolley to pig. This principle is illustrated in FIG. 20, where the pig's magnet teeth 33*a* interact with the array of magnets 40 (in the trolley) outside the pipe 5. This provides for a concentration of the magnetic field around the teeth (similar to that of the poles of a horseshoe magnet), which yields an improved motive force on the pig. The depth and width of the slots are configured to suit the force requirements, also in consideration of the overall pig dimension. The magnetic bar in the trolley has the same slot/tooth length as the magnetic/magnetized bar in the pig.

Figure 17A:
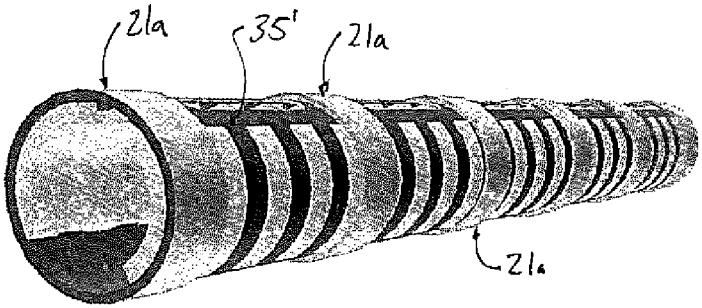
FIG. 17*a* is a perspective view of yet another embodiment of the invented bidirectional pig.
Figure 17B:
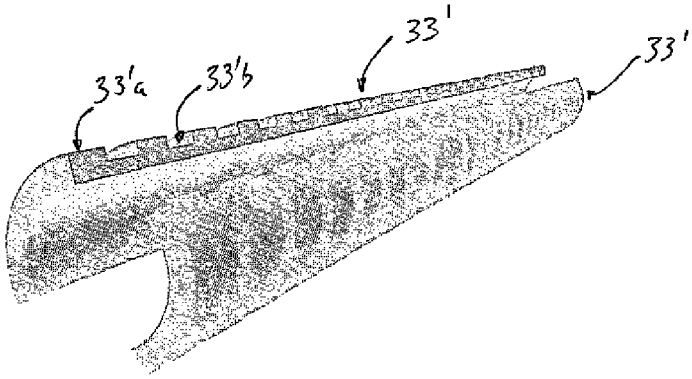
FIG. 17*b* is a perspective view of the magnetic elements used in the pig illustrated in FIG. 17*a;*
Figure 18:
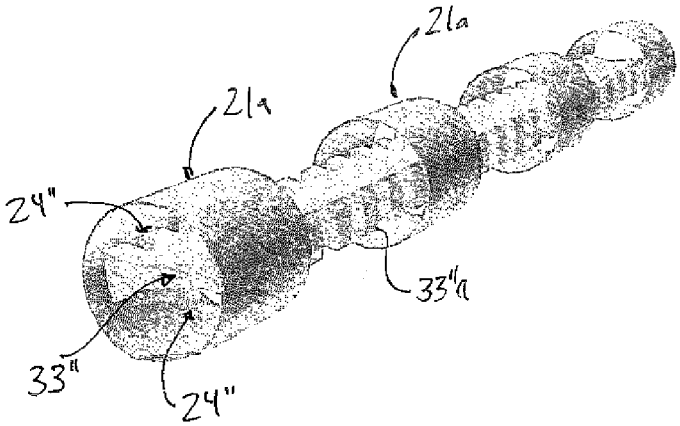
FIG. 18 is a perspective view of yet another embodiment of the invented bidirectional pig.
Figure 19:
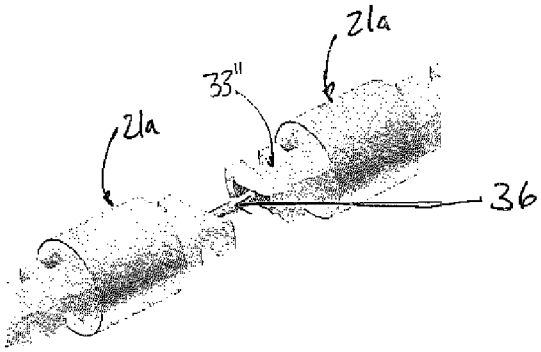
FIG. 19 is a perspective view of two interconnected pigs.

FIGS. 17*a,b* show a similar configuration, having larger magnet rods 33' which provide a greater contact area. FIG. 18 shows yet another embodiment of the pig, where a magnet rod 33" (magnetizable material or a permanent magnet material) makes up the plug body. The magnet rod 33" has successive teeth 33"*a* and slots 33"*b* and provides a central core and is carried by a plurality of scraper rings 21*a*, thus defining two non-circular through-going flow openings 24". FIG. 19 shows how successive pigs may be interconnected via a link 36 to form train.

Thus, the pig may be propelled by a controlled manipulation of the magnetic field affecting it. By controlling the magnetic field, the pig may be driven in either direction within the pipe, and at speeds that are appropriate for the given practical application. The pig may be supported by wheels, sliding supports, and/or directly by the scraper, as discussed above.

Figure 5:
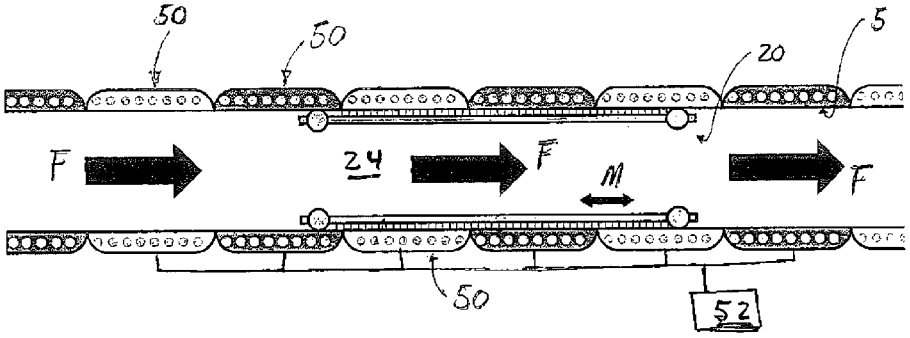
FIG. 5 is a longitudinal section view of a bidirectional pig in a pipe surrounded by electromagnetic coils according to the invention.
Figure 14:
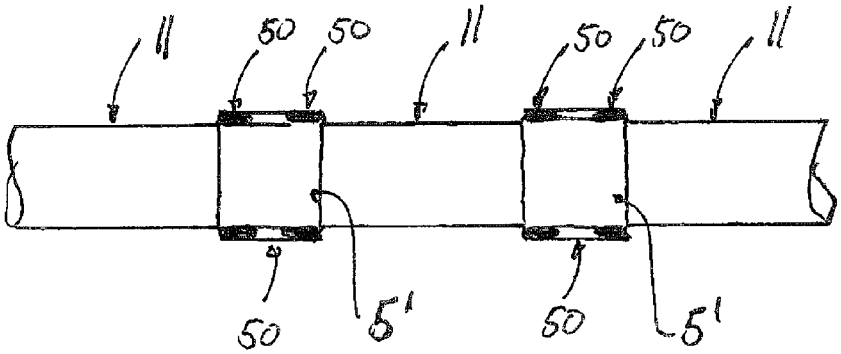
FIG. 14 is a side view of yet another embodiment of the pipe.

FIG. 5 illustrates an embodiment where a number of electromagnetic coils 50 are arranged around the pipe 5. The coils 50 are connected to a power supply and control device 52. The coils may be placed around and on the outside of the pipe (as illustrated), or may be embedded in the pipe wall. The individual electromagnetic coils 50 may be energised sequentially by the control device 52 (this is indicated by the alternating grey and white pattern in FIG. 5) to generate magnetic fields that interact with the magnetic pig body, whereby the pig 20 is pushed or pulled along inside the pipe. The bristles sweep along the pipe wall, removing wax, hydrates and other components. The coils do not necessarily need to be arranged in the end-to-end relationship shown in FIG. 5, but may be arranged with an axial spacing. Alternatively, referring to FIG. 14, the cooling pipe may comprise sections of steel pipe 11 and sections of non-magnetic pipe 5'. The non-magnetic pipe sections 5' comprise one or more electromagnetic coils.

Figure 6A:
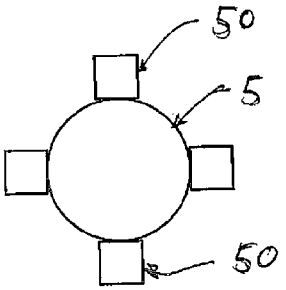
FIGS. 6*a* and 6*b* are a cross section and perspective views, respectively, of the pipe, showing an alternative arrangement of the electromagnetic coils.
Figure 6B:
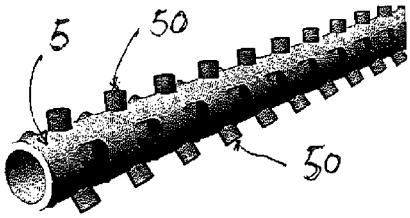

The electromagnetic coils may be oriented parallel, axially, radially (see FIGS. 6*a*, 6*b*) or angled with respect to the pipe. The coils may also comprise a rib structure (not shown) or similar, allowing for efficient cooling by the ambient seawater.

Figure 7:
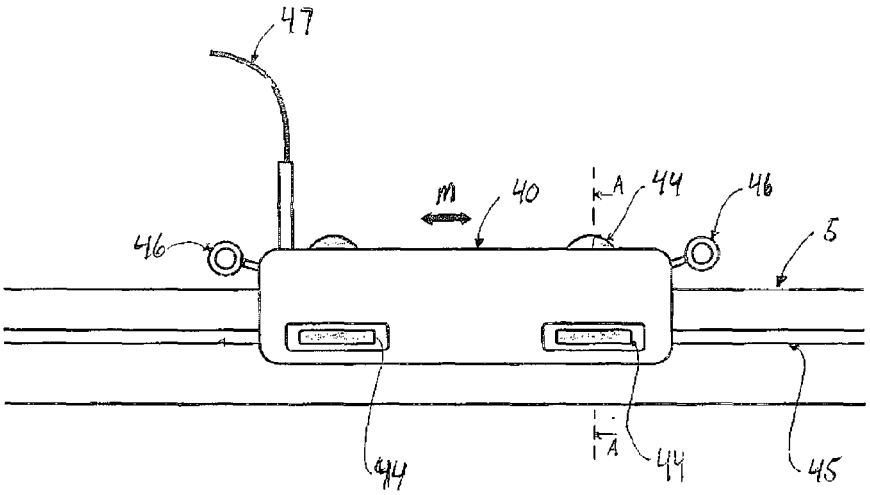
FIG. 7 is a side view of the pipeline and a magnetic trolley according to the invention.
Figure 8:
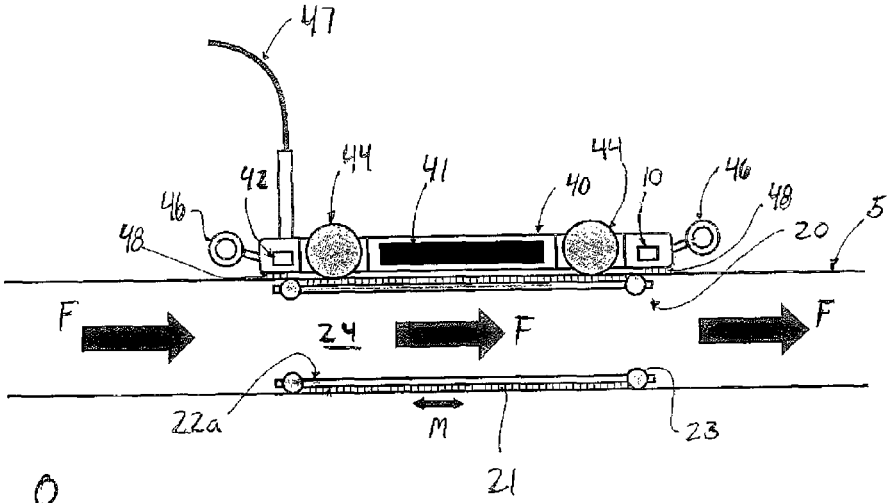
FIG. 8 is a longitudinal section view of the embodiment illustrated in FIG. 7, showing also a bidirectional pig inside the pipe.
Figure 9:
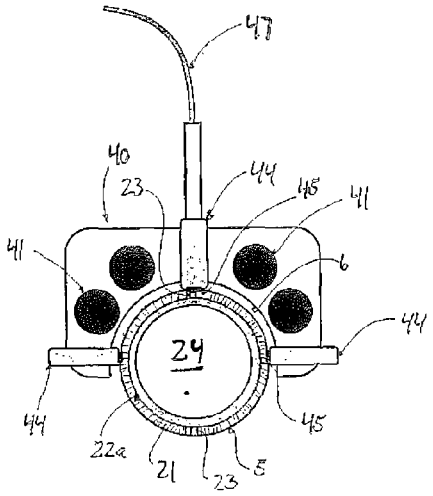
FIG. 9 is a cross section view as seen towards the section line A-A in FIG. 7.

FIGS. 7, 8 and 9 illustrate another device for propelling the pig inside the pipe. A trolley 40, having a semi-cylindrical recess 6 which is complementary with the outside wall of the pipe 5 is arranged on the outside pipe wall, and enclosing a part of the pipe circumference (see FIG. 9). The trolley 40 is in the illustrated embodiment supported onto the pipe 5 by a number of rollers or wheels 44, whereby the trolley may move in either direction along the pipe (indicated by double arrow M). A rail structure (not shown) on which the trolley may move (track, interface, interact), may also be provided on or between adjacent pipes. External cleaning elements (wipers, brushes, or bristles) 48 are conveniently arranged at both ends of the trolley, in order to sweep away debris, fouling and/or ice on the outside of the pipe which otherwise might impede the trolley's travel along the pipe. This cleaning of the pipe exterior also improves the heat-exchange between the well fluids in the pipe and the surroundings (i.e. air if on land, seawater if subsea). The external cleaning elements 48 may thus extended in a circumferential direction in order to sweep a greater surface area of the outer pipe wall.

Figure 15:
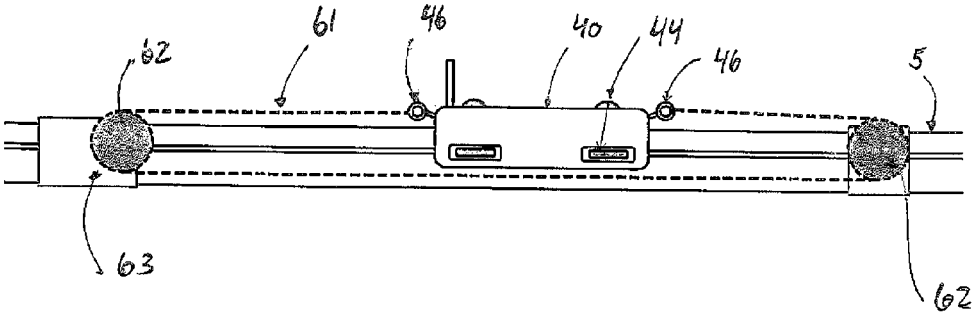
FIG. 15 is a side view of the pipeline and an alternative embodiment of the magnetic trolley according to the invention.

Referring additionally to FIG. 15, padeyes 46 are arranged at both ends of the trolley, by means of which the trolley may be pulled back and forth on the pipe, and also be retrieved to the surface for maintenance. In this case, wires or chains 61 are connected to respective wheels or pulleys 62 at both ends of the pipe 5, driven by an electric motor 63.

The wheels 44 are in the illustrated embodiment driven by an electric motor (schematically indicated as reference number 42), which may be powered by on-board batteries or from an external source via an umbilical 47. The wheels may be rubber wheels, rolling directly on the pipe outer wall. The wheels 44 may also be gear wheels, rolling in a pitch rack 45 in a rack-and-pinion configuration.

In the embodiment illustrated by FIGS. 7-9, the trolley comprises one or more magnets 41, which may be permanent magnets or electromagnets. Power to the electromagnets is provided by on-board power supplies 10 or from a distal power source via the umbilical 47. The magnetic field generated by the magnet 41 interacts with the magnetic material in the pig 20, holding the pig in proximity of the trolley. Thus, the pig and the trolley are magnetically locked to each other, and the pig moves along with the trolley when the trolley is moved along the pipe 5, indicated by the double arrow M. The pig's bristles or scrapers sweep along the pipe wall, removing wax, hydrates and other components.

The magnet 41 may also be controlled so as to generate a magnetic field which opposes that of the pig body, in which case the trolley will seek to repel the pig and hence push it along inside the pipe.

Figure 10:
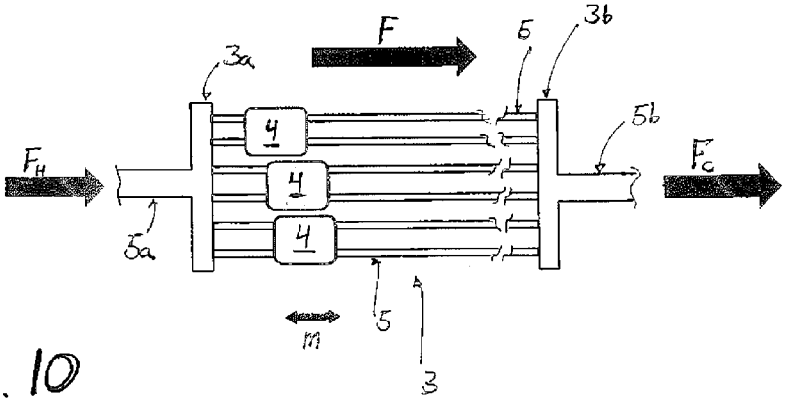
FIG. 10 is a top view of a part of the subsea processing plant according to the invention.

Returning now to FIG. 1, the bidirectional pig and the magnetic propulsion system is advantageously employed in the cooling section 3 of a subsea processing plant on the seabed. In the illustrated embodiment, magnetic trolleys on adjacent pipes 5 have been grouped together to form trolley units 4. This is also illustrated in FIG. 10, showing a schematic view of the cooling section. The individual trolley units may be run independently of one another or may be coupled together.

In FIG. 10, comparably warm well fluids $F_H$ are fed (from subterranean reservoirs, and e.g. via a PLEM) into the cooling section 3 where they flow through the individual cooling pipes 5 (indicated by arrow F). Here, heat exchange with the ambient seawater takes place, by thermal convention through the pipes' wall. When the fluids reach the outflow manifold 3*b*, the temperature of the well fluids is on the same level as the temperature of the seawater, and the cooled well fluids $F_C$ are fed into the export pipeline 5*b*. During such operation of the processing plant, the trolley units 4 may be moved back and forth, as an when desired or required, in order to clean the inside of the cooling pipes 5, without impeding the well stream flow.

Figure 11:
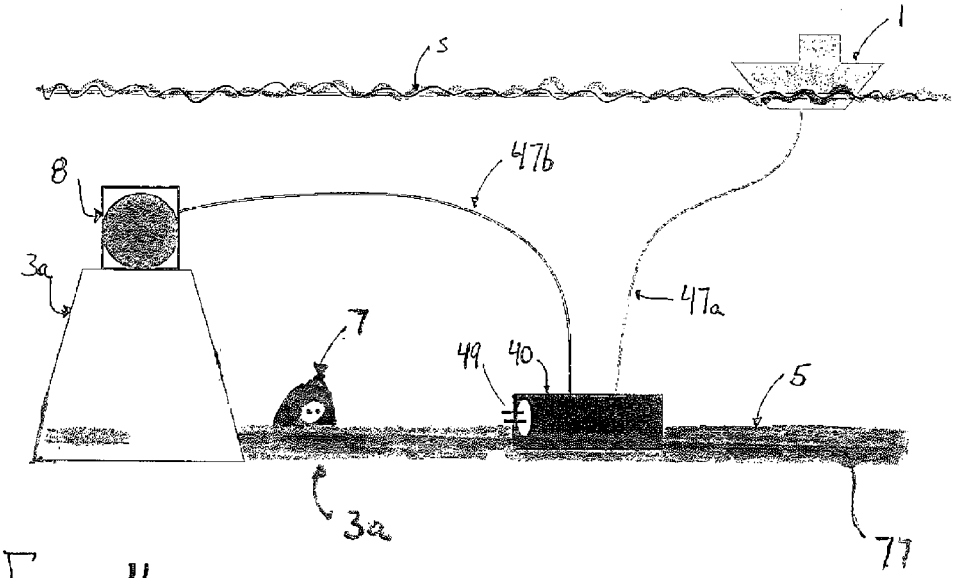
FIG. 11 is a side view of the subsea processing plant according to the invention, illustrating also power and communication means.

FIG. 11 illustrates an embodiment where the trolley 40 (or trolley unit) is furnished with a connector 49 and the inflow manifold 3*a* comprises a docking station 7, connected to a power supply via the PLEM, in a fashion which is known per se. The power sources (i.e. batteries) in the trolley (described above) may thus be charged, e.g. by induction, when the trolley is in an inactive, parked, position adjacent to the inflow manifold. Power may also be provided to the trolley 40 via a rail 77 on the pipeline.

The trolley or trolley units may be controlled either via an umbilical 47*a* from a surface vessel 1 or via an umbilical 47*b* from a control unit 8 that is connected to the PLEM.

Figure 12:
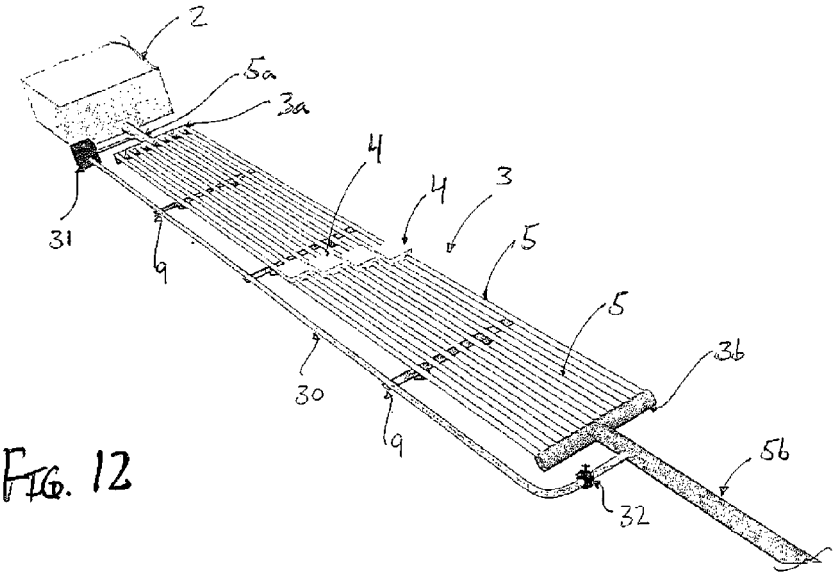
FIG. 12 is a perspective view of an alternative embodiment of the subsea processing plant according to the invention.
Figure 13:
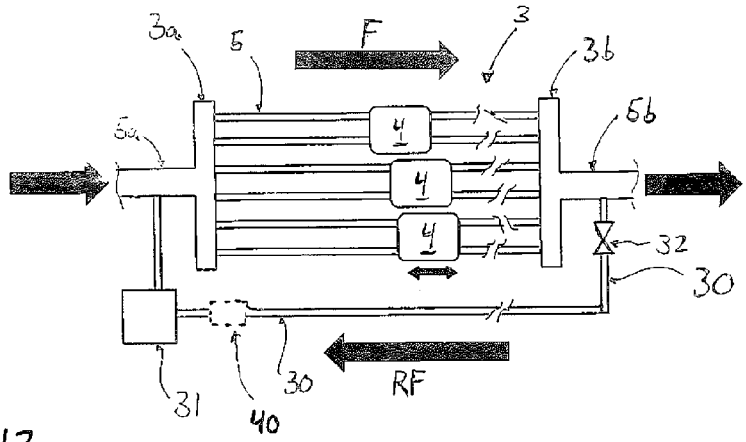
FIG. 13 is a top view of a part of the subsea processing plant which is illustrated in FIG. 12.

Referring now to FIGS. 12 and 13, the cooling section 3 may advantageously comprise a return line 30, fluidly connecting the export line 5*b* (i.e. the "cold" side) with the pipe section 5*a* (i.e. the "warm" side). A pump 31 and a valve 32 are arranged in the return line, whereby a desired fraction of the cooled flow emanating from the cooling section 3 may be fed into the warmer well fluids flowing in the pipe section 5*a*, thus lowering the temperature in the flow upstream of the cooling section 3. (The pump and the valve are remotely controlled in a manner which per se is known and therefore not illustrated here.) Another beneficial effect of feeding a fraction of the cooled fluids into the warm well stream before it enters the cooling section, is introducing comparably dry hydrate particles into the flow. These dry hydrate particles are in effect condensations seed particles for wax and gas hydrates, forming kernels for the further particle growth. Thus, inert and dry hydrate particles are suspended in the liquid phase as the well stream enters the cooling section, yielding less deposit on the pipes in the cooling section. Dry hydrates are not as problematic as sticky hydrate slurry or wet hydrate formed on water molecules.

The return line 30 may optionally be furnished with a pig according to the invention, propelled by any of the methods and devices described above, for example by a trolley 40 (illustrated in dotted lines in FIG. 13).

Although the cooling section 3 has been illustrated as a section having parallel, straight pipes 5, the cooling section may in certain applications advantageously be arranged in a circular, spiral, configuration, with the control unit for the magnet trolley in the centre. This configuration will reduce the length of the umbilical between the control unit and the trolley. The invention may also be used in a closed loop cooling section. The plant may also comprise a by-pass line (not shown) between the PLEM and the export pipeline (with associated shunt control valves).

Although the invention has been described with reference to a subsea plant for hydrocarbons, the invention may also be implemented in a land based installation, in which case air may be the cooling medium. Alternatively, in a land-based installation, the cooling medium may be a liquid, such as water.

Although the invention has been described with reference to a cooling section of a subsea plant for hydrocarbons, the invention is also applicable in any pipeline, where a pig, plug or other object is moved in controlled manner by any of the propulsion means described above.

The invention claimed is:

1. A bi-directional pig apparatus for removing wax and hydrate deposits in subsea hydrocarbon production flowlines, the apparatus comprising:

a pig arranged for movement inside at least a portion of a pipe wherein the pig comprises:

a non-magnetic tubular body having a longitudinal axis coinciding with a central axis of the portion of the pipe, and one or more magnets comprising a permanent magnet or a magnetisable material arranged in a circumferential wall of said body;

at least one through-going opening between opposite ends of said tubular body to allow fluids (F) in the pipe to flow through said body;

a propulsion means arranged and configured for imparting a motive force to the pig, whereby the pig is movable in either direction inside the portion of the pipe independently of fluid flow in the pipe; and the propulsion means comprises a vehicle having at least one magnet and being arranged and configured for movement along at least a part of the portion of the pipe, whereby, when the vehicle is moved along the portion of the pipe, the pig is moved along with the vehicle due to magnetic force generated between the magnet and magnetic material in the pig.

2. The apparatus of claim 1, wherein the portion of the pipe comprises a material of high magnetic permeability.

3. The apparatus of claim 1, wherein the vehicle comprises wheels and a motor for moving the vehicle along the portion of the pipe, and wherein the at least one magnet is a permanent magnet or an electromagnet.

4. The apparatus of claim 1, wherein the vehicle further comprises one or more cleaning elements arranged and configured for cleaning an outer surface of the portion of the pipe as the vehicle is moving along the pipe.

5. The apparatus of claim 1, wherein the pig further comprises a flow assurance device having wall-cleaning means arranged around at least a portion of a body of the pig.

6. A bi-directional pig apparatus for removing wax and hydrate deposits in subsea hydrocarbon production flowlines, the apparatus comprising:

a pig arranged for movement inside at least a portion of a pipe wherein the pig comprises:

a non-magnetic tubular body having a longitudinal axis coinciding with a central axis of the portion of the pipe, and one or more magnets comprising a permanent magnet or a magnetisable material arranged in a circumferential wall of said body;

at least one through-going opening between opposite ends of said tubular body to allow fluids (F) in the pipe to flow through said body;

a propulsion means arranged and configured for imparting a motive force to the pig, whereby the pig is movable in either direction inside the portion of the pipe independently of fluid flow in the pipe, wherein each of the one or more magnets comprises an elongated bar having a succession of teeth and slots, arranged such that the succession of teeth is facing radially outwards.

7. A bi-directional pig apparatus for removing wax and hydrate deposits in subsea hydrocarbon production flowlines, the apparatus comprising:

a pig arranged for movement inside at least a portion of a pipe wherein the pig comprises:

a non-magnetic tubular body having a longitudinal axis coinciding with a central axis of the portion of the pipe, and one or more magnets comprising a per magnet or a magnetisable material arranged in a circumferential wall of said body;

at least one through-going opening between opposite ends of said tubular body to allow fluids (F) in the pipe to flow through said body;

a propulsion means arranged and configured for imparting a motive force to the pig, whereby the pig is movable in either direction inside the portion of the pipe independently of fluid flow in the pipe, wherein the propulsion means is a trolley having a semi-cylindrical recess which is complementary with a outside wall of the portion of the pipe, the trolley being arranged on the outside wall of the portion of the pipe and enclosing a part of a circumference of the pipe.

8. The apparatus claim 1, further comprising one or more wall-cleaning means arranged around an outside circumference of the tubular body.

* * * * *